US005513587A

United States Patent [19]

Takada et al.

[11] Patent Number: 5,513,587

[45] Date of Patent: May 7, 1996

[54] THREAD TENSIONING FOR CHAIN STITCH SEWING MACHINE

[75] Inventors: Takashi Takada; Masahiko Nishikawa, both of Osaka, Japan

[73] Assignee: Pegasus Sewing Machine Mfg. Co., Ltd., Osaka, Japan

[21] Appl. No.: 422,503

[22] Filed: Apr. 12, 1995

[30] Foreign Application Priority Data

Apr. 13, 1994 [JP] Japan ..... 6-100688

[51] Int. Cl.[6] ..... D05B 1/10; D05B 47/00

[52] U.S. Cl. ..... 112/165; 112/254

[58] Field of Search ..... 112/163, 165, 112/167, 168, 197, 243, 245, 241, 242, 254, 255, 302, 470.12

[56] References Cited

U.S. PATENT DOCUMENTS

| | | | |
|---|---|---|---|
| 827,654 | 7/1906 | Onderdonk | 112/245 |
| 4,186,676 | 2/1980 | Villa et al. | 112/165 |
| 4,821,661 | 4/1989 | Brownlee | 112/254 X |
| 4,934,291 | 6/1990 | Yamamoto | 112/163 |
| 4,949,657 | 8/1990 | Hanyu et al. | 112/470.12 |
| 5,027,728 | 7/1991 | Prina | 112/197 |
| 5,138,961 | 8/1992 | Nakano et al. | 112/163 X |
| 5,398,627 | 3/1995 | Nishikawa | 112/165 X |

FOREIGN PATENT DOCUMENTS

| | | | |
|---|---|---|---|
| 14-5653 | 3/1939 | Japan . | |
| 61-25754 | 8/1986 | Japan . | |
| 2292190 | 12/1987 | Japan | 112/254 |

*Primary Examiner*—C. D. Crowder
*Assistant Examiner*—Ismael Izaguirre
*Attorney, Agent, or Firm*—Flynn, Thiel, Boutell & Tanis

[57] ABSTRACT

In a multi-needle double chain stitch sewing machine, when forming a thread chain after forming a seam without using upper cover thread, formation of loop or excess looseness of the right needle thread is prevented. A U-shaped guide having a pair of thread eyes at both opposing ends is fixed at the lower end of a needle bar, and a thread take-up cam extending in the vertical direction is fixed on the sewing machine frame between said thread eyes. The upper half of the cam working surface has a linear shape and the lower half has a sloping curve. The right needle thread passed between the thread eyes is brought into contact with the cam, and when the U-shaped guide descends together with the needle bar, the right needle thread is gradually bended.

3 Claims, 5 Drawing Sheets

FIG. 3
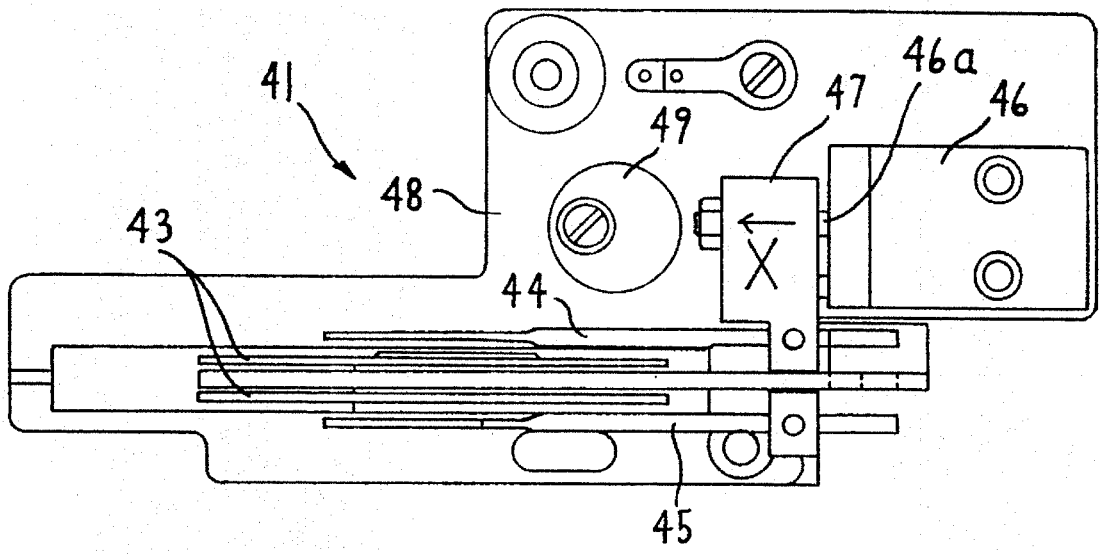
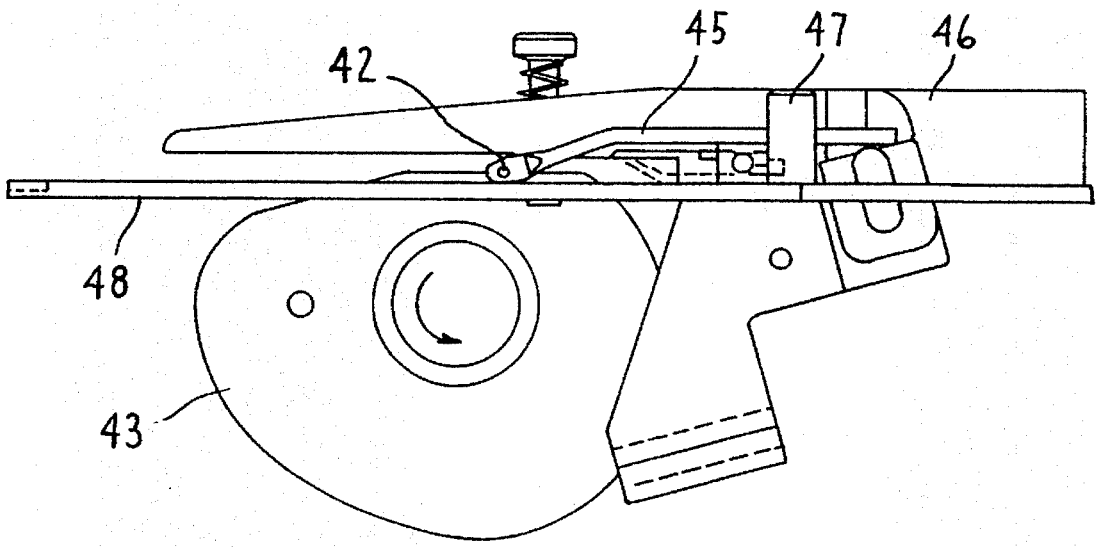
FIG. 4

THREAD TENSIONING FOR CHAIN STITCH SEWING MACHINE

FIELD OF THE INVENTION

The present invention relates to a multi-needle double chain stitch sewing machine, and more particularly to a two-needle or three-needle double chain stitch sewing machine for smoothly forming a thread chain successively to the seam at the sewing end portion of a workpiece.

BACKGROUND OF THE INVENTION

Generally, when sewing workpieces by a sewing machine, it is more productive if the sewing operation can be continued without stopping the drive of the sewing machine even at the sewing end of a workpiece by feeding a new workpiece successively. For example, as shown in FIG. 6, using a two-needle double chain stitch sewing machine 5 which has two needles 2, 3 provided parallel to right and left side on the lower end of a needle bar 1 moving vertically, and a looper 4 traversing to the needles from the right side, when forming seams (stitch types 602, 605, 855, etc. of United States Federal Standard) on the workpiece, the thread chain linking between the sewing end of the workpiece and a seam to be made on a next workpiece is smoothly drawn out as the upper cover thread of the seam is supported on the tongue of a needle plate 6.

However, when forming other seams without upper cover thread (stitch types 402, 406, 407, etc. of USFS) on the workpiece, the thread chain consecutive to the sewing end of the workpiece is not supported on the tongue of the needle plate 6 because there is no upper cover thread, and the thread chain is falling into a U-shaped hole flanging the tongue and cut with the traversing looper, and continuous sewing operation is disabled.

To draw out the thread chain smoothly, in a certain case, thread tension devices 7*a*, 8*a*, 9*a* for sewing, and thread tension devices 7*b*, 8*b*, 9*b* for forming thread chain are provided respectively for left and right needle threads 7, 8 and looper thread 9, and threads are passed through both thread tension devices, and the thread tension devices are changed over at the sewing end so that only the former will work when sewing, and only the latter will work when forming thread chain. In other cases, the needle plate, feed dog, and presser foot are improved. Such techniques are disclosed in Japanese Utility Patent Publication No. 39-5653, No. 61-25754, Japanese Patent Publication No. 57-58191 (U.S. Pat. No. 4,186,676), Japanese Laid-open Patent No. 3-23887 (U.S. Pat. No. 5,027,728) and No. 5-300991 (U.S. Pat. application Ser. No. 08/051,481, now U.S. Pat. No. 5,398,627).

For drawing out the thread chain smoothly, it is effective to converge two needle threads into a condensed and slender thread chain, and for this purpose it is better to decrease the tension by the thread tension device 8*b* for the right needle thread 8, and increase the tension by the thread tension device 9*b* for the looper thread 9. However, the loosened right needle thread 8 may oscillate irregularly when the needle 3 descends, or droop to be caught on the looper 4 near the under end point of the needle 3, or not be converged sufficiently to form occasional small loops L on the thread chain TC, as shown in FIG. 7, formed consecutively to the sewing end seam S of the workpiece W. Then the small loops L are come out of the thread chain TC, and the loops L may be caught on the feed dog and or the looper, and the thread chain may be cut off.

SUMMARY OF THE INVENTION

It is the primary object of the invention to provide a multi-needle double chain stitch sewing machine which draws out a thread chain smoothly even when sewing without using upper cover thread and more particularly it is an object of the invention to provide a sewing machine which loosens the right needle thread sufficiently, absorbs and reduces an excessive loop and sag accompanied by loosening.

It is further object of the invention to provide the sewing machine having a U-shaped guide with a pair of thread passing eyes which is fixed near a needle holder mounted on the lower end of the needle bar, and a thread control plate having a cam extending vertically between said pair of thread passing eyes and being fixed on a sewing machine frame. The working surface of the cam has an upper half shaped a straight edge parallel to the moving direction of the needle bar, and has a lower half shaped a sloping curved edge. When the U-shaped guide descends along with the descent of the needle bar, the right needle thread passed between the thread passing eyes is bended gradually larger.

When forming a thread chain after changing over the thread tension devices at the sewing end, the loosened and slight sagging right needle thread is prevented from oscillating at the straight edge in the upper half of the cam, and at the lower half of the cam along with the descent of the needle bar, the right needle thread is gradually bended deeply by the sloping curved edge between the pair of thread passing eyes, and the droop due to sagging is absorbed, thereby preventing formation of small loops due to projection of the right needle thread. As a result, the thread chain is drawn out smoothly.

It is another object of the invention to provide a sewing machine having two thread guides for passing a looper thread, and a thread take-up cam for bending the looper thread passing through the thread guides. The relative position of the thread guides and thread take-up cam is changeable. By this change, the thread take-up amount of the looper thread by the thread take-up cam at the time of forming thread chain is decreased than when sewing, so that the thread chain may be slender.

It is still a further object of the invention to provide first and second thread tension devices for the right needle thread and looper thread respectively, and a tension release device for canceling the action on the looper thread of the second thread tension device at the time of sewing, and for canceling the action on the right needle thread of the second thread tension device at the time of forming a thread chain, thereby preventing disturbance of threads when changing over.

Other and further objects, features and advantages of the invention will appear more fully from the following description. It is to be expressly understood, however, that the drawings are for purpose of illustration only and are not intended as a definition of the limits of the invention.

BRIEF DESCRIPTION OF THE DRAWINGS

FIG. 3 is a plan view of a thread take-up of the invention.

FIG. 4 is a front view of the thread take-up of the invention.

DETAILED DESCRIPTION OF THE INVENTION

Figure 1:
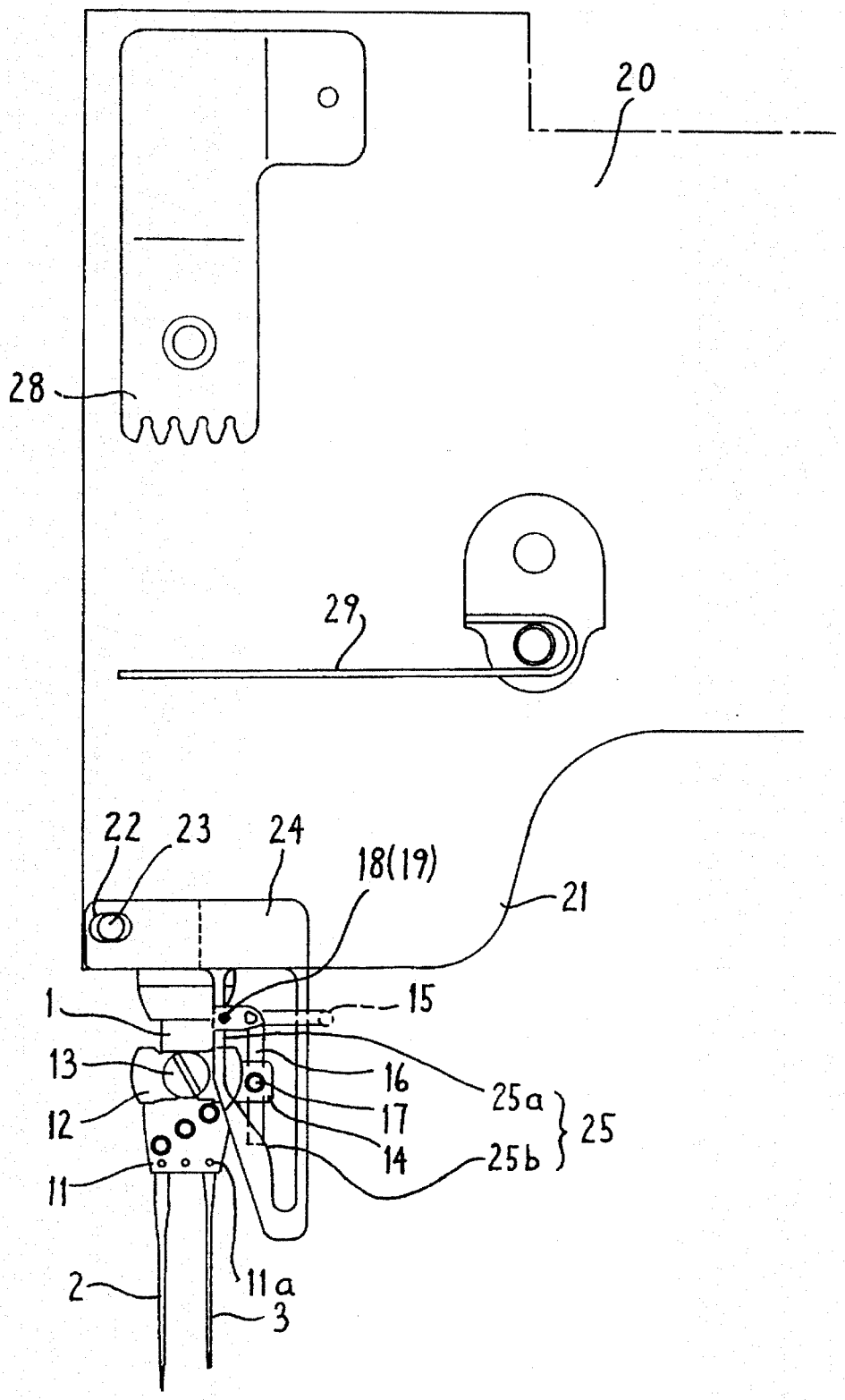
FIG. 1 is a front view of essential parts of an embodiment of the invention.

The sewing machine according to the invention and its action are described in detail below while referring to FIGS. 1 to 5, and the parts common to the conventional sewing machine should be referred to FIG. 6. As shown in FIG. 1, in this sewing machine, a left needle 2 and a right needle 3 are fixed in parallel on a needle holder 11 provided at lower end of a needle bar 1 moving up and down. To this needle holder 11, a needle compensate plate 12 which is pushed with a weak spring is fitted to the front side by a screw 13, and a hole penetrating vertically is formed in an arm 14 fitted and projecting to the right side on the needle holder 11, and a U-shaped thread guide 15 with a support leg 16 is fixed in this hole by penetrating the support leg 16 and by a screw 17 at a arbitrary height. This U-shaped thread guide 15 has a pair of thread eyes 18, 19 provided at both opposing ends of U-shaped prongs so as to pass a right needle thread 8 in the horizontal direction.

On the front side of a head 21 of a sewing machine arm 20 for supporting the needle bar 1, a thread control plate 24 capable of adjusting the lateral position through a slot 22 and a screw 23 is fixed. This thread control plate 24 is hollowed out to form an opening, and the inside edge extending in the vertical direction of the opening works as a cam working surface 25 to contact with and control the right needle thread 8. The upper half of the working surface 25 is formed in a vertical linear portion 25*a* along the needle bar motion direction across a straight line passing the thread eyes 18, 19. The lower half of the working surface 25 projects toward the base of the prongs of the U-shaped thread guide 15 and approaches gradually to it to be formed a sloping curved portion 25*b* and a vertical portion again in the lower part.

Figure 6:
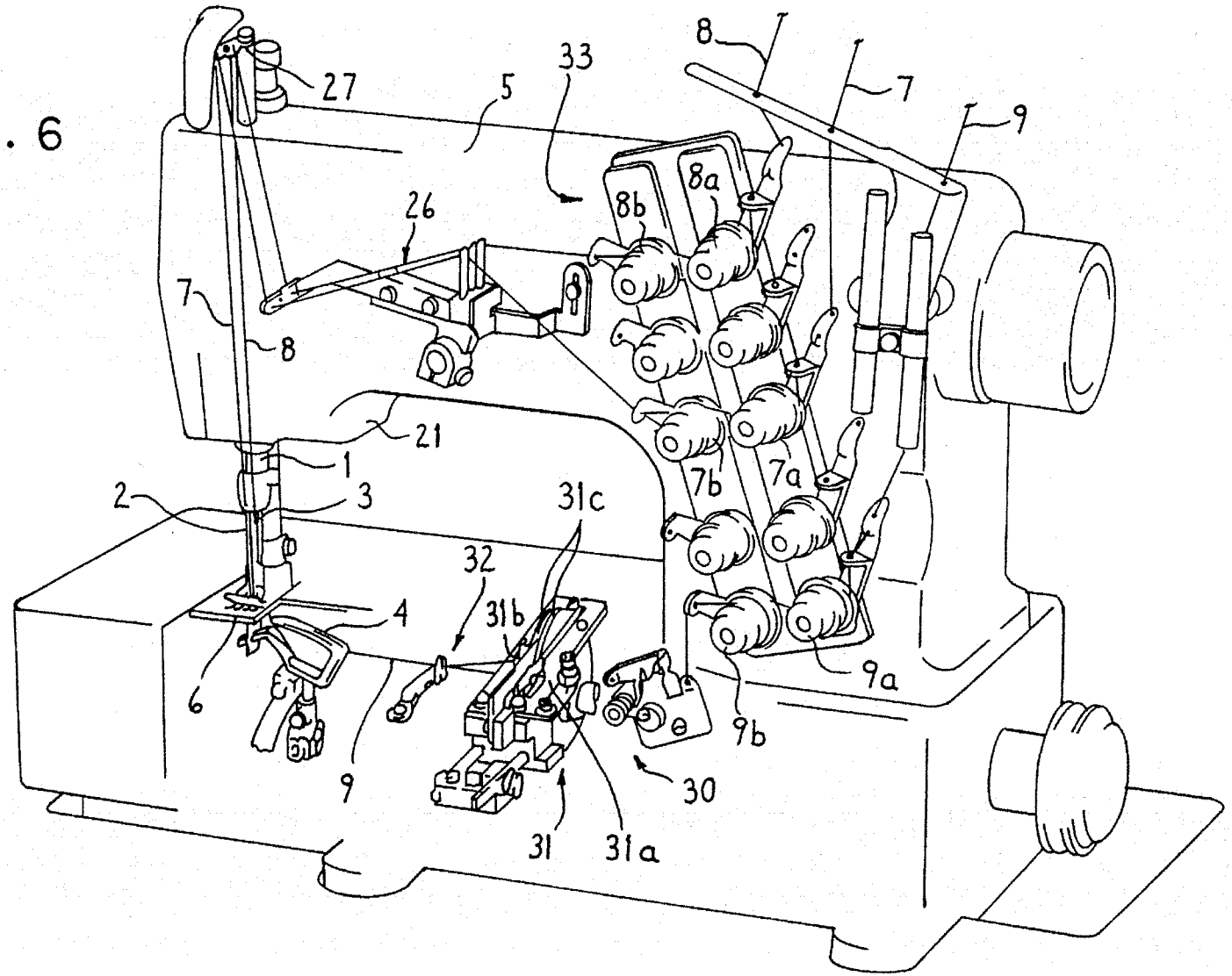
FIG. 6 is a perspective view of a double chain stitch sewing machine to which the invention may be applied.

The left needle thread 7 and right needle thread 8 are supplied through thread tension devices 7*a* and 7*b*, 8*a* and 8*b* in FIG. 6, a thread take-up 26, a needle bar thread guide 27 fixed on the upper end of the needle bar 1, a front thread guide 28 and a thread compensate bar 29 shown in FIG. 1. The left needle thread 7 is passed into the eye on the needle 2 through the thread compensate plate 12 of the needle holder 11. On the other hand, the right needle thread 8 is supplied through the thread compensate bar 29 and is guided from the thread eye 18 on the front side of the U-shaped thread guide 15 to the rear thread eye 19 through the opening on the thread control plate 24, and is passed into the needle eye of the right needle 3 through the thread compensate plate 12 and an eye 11*a* on the needle holder 11.

The looper thread 9 is guided to the looper 4 by way of the thread tension devices 9*a*, 9*b* shown in FIG. 6, a spring guide 30, a rotary thread take-up 31, and a thread guide 32. The rotary thread take-up 31 used herein may be a conventional thread take-up 31 comprising take-up cams 31*c* which rotate across between the thread eyes 31*a*, 31*b* in cooperation with the sewing machine and rotate so as to bend the thread route by contacting with the looper thread passed through the eyes, but should be preferably a rotary thread take-up 41 described later.

In this way, settling the thread tension devices 7*a*, 8*a*, 9*a* in active state, and 7*b*, 8*b*, 9*b* in inactive state, and leading the left and right needle threads 7, 8 and looper thread 9 into the sewing machine, a seam of stitch type 406 is formed on the workpiece. Coming to the terminal end of the workpiece, the thread tension devices are changed over for thread chain by means of the sensor (not shown) and a changeover mechanism 33, an example of which is the changeover mechanism of U.S. Pat. No. 5,398,627, and the tension of the right needle thread 8 is lowered, while the tension of the looper thread 9 is raised. In the continuous operation of the sewing machine, as the looper 4 moves to the left, the right needle thread 8 is pulled by the looper thread 9 of high tension beneath the needle plate 6 to be shifted toward the left needle thread 7, so that both needle threads 7, 8 and looper thread 9 form a thin and compact thread chain.

Figure 2:
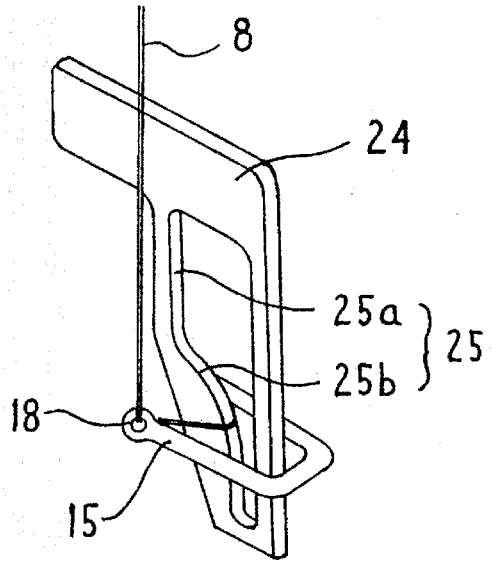
FIG. 2 is a perspective view of parts for explaining the action of the invention.
Figure 7:
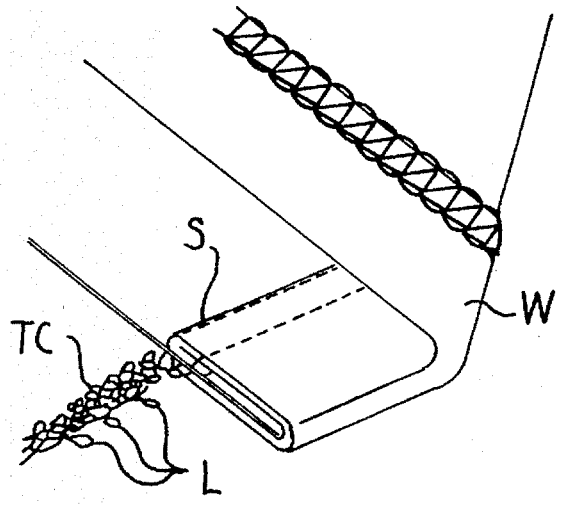
FIG. 7 is a perspective view showing a sewing end portion of workpiece in a conventional sewing machine.

At the time of forming this thread chain, in the needle descent process, the cam working surface 25*a* of the upper half of the cam lightly contacts with the right needle thread 8 to prevent oscillation of the thread 8, and in the lower half, the right needle thread loop hooked on the looper 4 slips out of the looper 4 along with the rightward motion of the looper, and at the same time the right needle thread 8 is largely bended gradually as shown in FIG. 2 on the sloping curved portion 25*b* of the lower half of the cam, thereby the sag occurred near the under end point of the needle bar is absorbed upward. As a result, a slender thread chain free from small loop L as shown in FIG. 7 is drawn out.

The invention therefore prevents problems experienced when forming a thread chain in the conventional sewing machine, that is, entangling of the loosened right needle thread 8 on the left needle thread and other parts of sewing machine due to oscillating in the descending process of the needle bar 1, drooping of thread chain near the under end point of the needle because of absence of workpiece or upper cover thread, or formation of abnormal loops due to projection of the loosened thread from the thread chain.

The height at which the working surface 25 begins to incline should be adjusted to the slipping out timing of the top end of the looper 4 from the right needle thread loop. But, depending on the properties of the thread and the like, the height of the U-shaped guide 15 may be adjusted by the screw 17, and the bending amount of the right needle thread 8 by the thread control plate 24 may be adjusted by the slot 22 and screw 23.

FIGS. 3 and 4 show the rotary thread take-up 41 suited to the looper thread for forming a thread chain. The rotary thread take-up 41 has two pins 44, 45 which are disposed parallel and opposite to each other with thread eyes 42 provided at the front ends (across the rotating thread take-up cam 43) and are fixed on a block 47 driven by a projecting rod 46*a* of an air cylinder 46. When forming a thread chain at the end of sewing, the air cylinder 46 is actuated and the block 47 is moved in the direction of arrow X, and the thread eyes 42 move in a direction for decreasing the bending amount of the looper thread by the thread take-up cam 43, and the thread take-up amount of the looper thread becomes smaller than when sewing, and the thread chain is further thin and compact and drawn out smoothly. On a bracket plate 48 of the rotary thread take-up 41, an eccentric ring 49 is screwed acting as a stopper for the block 47 which is driven back and forth, and by varying the fixing position of the eccentric ring 49, the stroke of the air cylinder 46 is varied, so that the thread take-up amount can be adjusted.

Figure 5A:
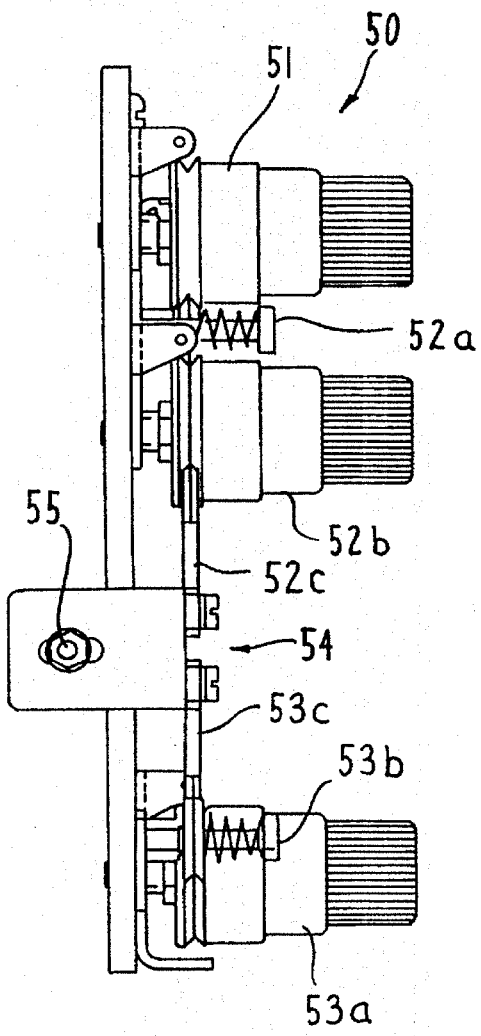
FIG. 5(A) is a side view of thread tension devices of the invention.

FIG. 5 shows a thread tension device suitable to the invention. This thread tension device 50 has only one thread tension device 51 for the left needle thread 7, and has first and second thread tension devices 52*a*, 52*b*, 53*a*, 53*b* for the right needle thread 8 and looper thread 9. The threads 8, 9 are passed in both thread tension devices. The thread tension device 50 is equipped with a tension release device 54, which has two integral projections 52*c*, 53*c* toward the second thread tension devices 52*b*, 53*b*, and by moving the projections right or left by driving means 55 composed of solenoid and air cylinder, the projections are invaded between the plates for holding the threads of the thread tension devices, thereby releasing the tension.

Figure 5B:
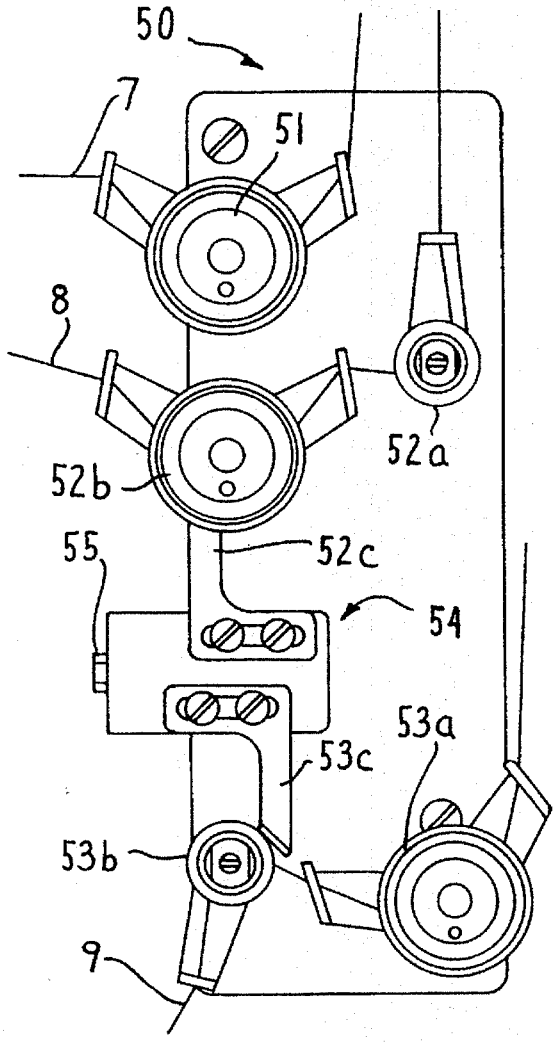
FIG. 5(B) is a front view of the thread tension devices of the invention.

At the time of sewing, the projection 53*c* acts on the second thread tension device 53*b* for the looper thread 9, and at the time of forming a thread chain, as shown in FIG. 5(B), the projection 52*c* acts on the second thread tension device 52*b* for the right needle thread 8, and therefore a high tension is applied to the right needle thread 8 when sewing, and a low tension is applied to the looper thread 9, and the relation of the tension is reversed at the time of forming a thread chain, that is, a low tension to the right needle thread 8 and a high tension to the looper thread 9. At the time of changing over, the first thread tension devices 52*a*, 53*a* always apply tension to the threads 8, 9, so that disturbance of the threads may be prevented.

What is claimed is:

1. A multi-needle double chain stitch sewing machine for forming a double chain stitch seam without an upper cover thread on a workpiece comprising:

at least two needles mounted on the right and left of the lower end of a needle bar, a looper reciprocating from the right side of the needle bar toward the needles, plural thread tension devices for applying thread tension to the needle threads and a looper thread passing through the needles and looper, a thread tension changeover device for controlling the thread tension devices to lower the thread tension of the right needle thread and raise the thread tension of the looper thread at the end of a sewing operation in order to form a thread chain, said sewing machine further comprising;

a U-shaped guide fixed near the lower end of the needle bar and having a pair of thread eyes at both opposing end of the U-shaped guide, and a thread control plate fixed on the frame of the sewing machine and having a downwardly extending cam, wherein an upper half of the cam is formed in a linear form in a direction of the needle reciprocating motion, a lower half of the cam is formed in a sloping curved form to cross between the pair of thread eyes, and when the U-shaped guide descends with the descent of the needle bar, the right needle thread passing through the thread eyes is bended gradually according to the descent of the thread eyes by the lower half of the cam.

2. A multi-needle double chain stitch sewing machine of claim 1, said sewing machine further comprising;

two thread guides for passing through the looper thread, and a thread take-up cam crossing between the thread guides to bend the looper thread passing through the thread guides, the thread take-up cam being provided between said thread tension devices and the looper, wherein a relative position between the thread guides and thread take-up cam is changeable, and by changing the relative position in sewing and in forming the thread chain, a thread take-up amount of the looper thread is changed over.

3. A multi-needle double chain stitch sewing machine of claim 1, wherein said thread tension devices have first and second thread tension devices for the right needle thread and looper thread respectively, each of the right needle thread and looper thread being applied thread tension by either the first and second thread tension devices or the only first thread tension device, and said tension changeover device comprising a tension release device which cancels an action on the looper thread of the second thread tension device for the looper thread at the time of sewing and an action on the right needle thread of the second thread tension device for the right needle thread at the time of forming the thread chain.

* * * * *